US005108310A

United States Patent [19]

Sawada et al.

[11] Patent Number: 5,108,310

[45] Date of Patent: Apr. 28, 1992

[54] ELECTRICAL CONNECTOR

[75] Inventors: Yoshitsugu Sawada; Takayuki Yamamoto; Masakuni Samejima, all of Shizuoka, Japan

[73] Assignee: Yazaki Corporation, Japan

[21] Appl. No.: 735,250

[22] Filed: Jul. 24, 1991

[30] Foreign Application Priority Data

Nov. 21, 1990 [JP] Japan ..... 2-121260[U]

[51] Int. Cl.[5] ..... H01R 13/426

[52] U.S. Cl. ..... 439/595; 439/594; 439/752

[58] Field of Search ..... 439/594, 595, 598, 599, 439/603, 752

[56] References Cited

U.S. PATENT DOCUMENTS

| | | | |
|---|---|---|---|
| 4,357,066 | 11/1982 | Cairn et al. | 439/595 |
| 4,921,448 | 5/1990 | Endo et al. | 439/595 |
| 4,932,899 | 6/1990 | Sueyoshi et al. | 439/595 |
| 4,959,023 | 9/1990 | Watanabe et al. | 439/594 |
| 4,975,082 | 12/1990 | Nagasaka et al. | 439/595 |
| 5,044,991 | 9/1991 | Colleran et al. | 439/595 |

FOREIGN PATENT DOCUMENTS

| | | | |
|---|---|---|---|
| 59-17093 | 5/1984 | Japan . | |
| 61-7875 | 1/1986 | Japan . | |
| 0160386 | 6/1990 | Japan | 439/595 |

*Primary Examiner*—Paula A. Bradley
*Attorney, Agent, or Firm*—Wigman & Cohen

[57] ABSTRACT

An electrical connector (11) including a housing (13), arms (27) defectable into a space (31) disposed under the arms (27), and a spacer block (17) finally positioned in the space (31) for preventing involuntary deflection of the arms. A projection (27*a*) of the arm (27) engages with a splicer in the connector (11) to prevent the splicer from coming out of the connector. The spacer block (17) has devices (35*a*, 35*b*) by which the spacer block (17) is placed and engaged in a temporary position in the connector, and has an inclined portion (37) on which an implement for disengaging the projection (27*a*) from the splicer is guided accurately to a forked end (27*a*, 27*b*) of the arm (27).

4 Claims, 5 Drawing Sheets

ELECTRICAL CONNECTOR

TECHNICAL FIELD

The present invention relates to an electrical connector. in particular, to a connector having devices with which an implement associates to disengage a projection or protuberance provided in the connector from an electrical splicer.

BACKGROUND ART

In the prior art, a connector provided with a deflectable arm which engages with a splicer positioned in the connector is well known as disclosed in Japanese Patent (Y2) 59-17,093. The arm has a projection at a free end for engaging with the splicer. The arm is elastic and deflectable into a space disposed at one side opposite the projection. Therefore, the splicer is introduced in the connector while the projection of the arm is pressed into the space by the splicer. The splicer is finally positioned in the connector and fixed by engaging the projection elastically returned to the first position with a notch formed in the splicer.

A connector disclosed in Japanese Patent (U) 61-7,875 has a spacer block disposed in the space for preventing the arm from deflecting involuntarily into the space.

It is necessary, however, to withdraw the splicer once engaged with the projection for some reasons, such as failure in electrical conductivity and introduction of an unappropriated splicer. In that case, the projection is pressed by an implement into the space for disengagement from the splicer.

However, pressing of the projection by the implement is not easy, because the projection is tiny and difficult to see in the connector. Sometimes, the projection is broken when engaged and pressed by the implement. In addition, if the connector has the spacer block, the spacer block must be removed from the connector first before the use of the implement and then inserted again in the space after an appropriate splicer is introduced in the connector.

SUMMARY OF THE INVENTION

It is therefore the object of the present invention to clear the above mentioned problems and provide an improved connector which causes an implement to pull out the splicers from the connector easily and quickly.

To achieve the object, an electrical connector of the present invention includes a housing; at least an arm fixed in at least one chamber disposed in the housing, having a first projection at a free end, and deflectable into a space disposed at one side opposite the first projection, the first projection being for engaging with an electrical splicer positioned in the chamber and for preventing the splicer from disengaging from the chamber; and at least a spacer block disposed finally in the space for preventing the arm from deflecting into the space, characterized in that the spacer block has devices by which the spacer block is engaged with the housing in a temporary position different from the space which is a final position for the spacer block, and that the spacer block has a guiding portion through which an implement for disengaging the first projection from the splicer is guided to the first projection of the arm when the spacer block is in the temporary position.

The above electrical connector is, for example, characterized in that the guiding portion of the spacer block includes an inclined surface which extends to the first projection of the arm when the spacer block is in the temporary position.

The electrical connector of the above example is characterized in that the arm includes a second projection at the free end which forms a fork with the first projection, and that an intersection of the first and the second projections is on a surface extended from the inclined surface of the guiding portion of the spacer block when the spacer block is in the temporary position.

The above electrical connector is, for example, characterized in that the guiding portion includes a groove for guiding the implement to the first projection, the groove being narrower than the first projection in width.

As the connector of the present invention is designed as mentioned above, the implement can be guided to the free end of the arm and engaged with the projection quickly, easily, and accurately without peeping in the space. In addition, it is possible to disengage the splicer from the projection without pulling out of the spacer block.

BRIEF DESCRIPTION OF THE DRAWINGS

FIG. 4A shows that a spacer block is not inserted in a space under an arm; FIG. 4B shows that the spacer block is in a temporary position; and FIG. 4C shows that the spacer block is in the final position in the space.

DESCRIPTION OF THE PREFERRED EMBODIMENTS

Now, the connector of the present invention will be described in detail with reference to the accompanying drawings.

Figure 1:
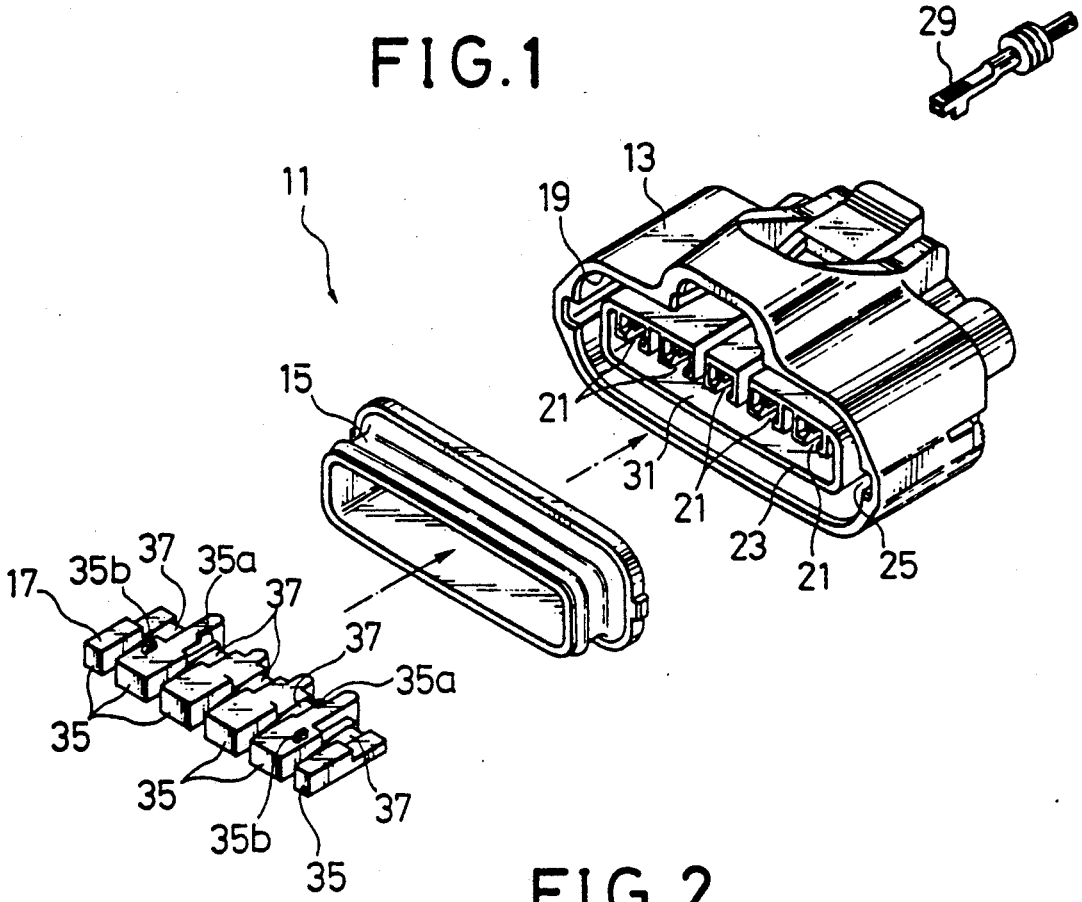
FIG. 1 is a diagrammatical perspective view of a connector of the present invention.
Figure 2:
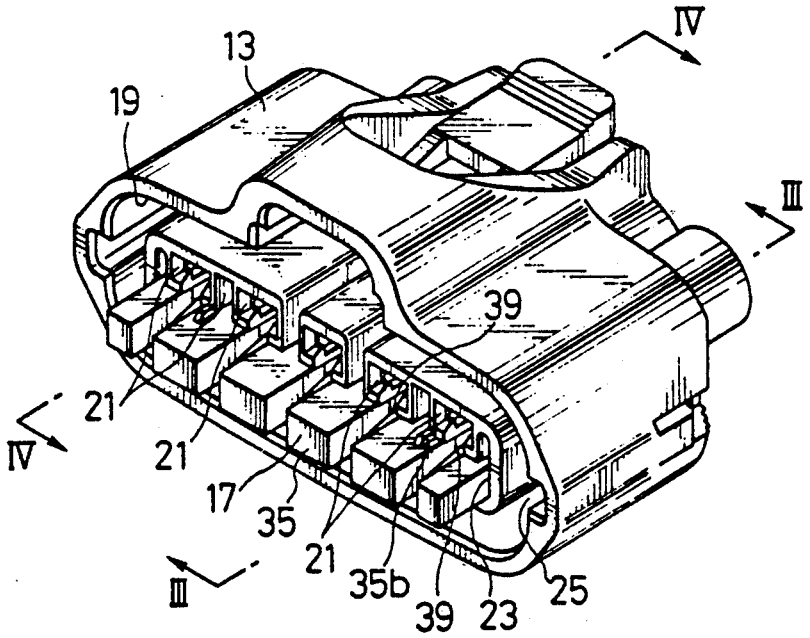
FIG. 2 is an enlarged perspective view of the connector shown in FIG. 1, showing that a spacer block is in a temporary position in a housing of the connector.

In FIG. 1, a connector 11 of the present invention is shown. The connector 11 mainly consists of a housing 13 having an inner wall 19, a seal 15, and a spacer block 17. These main components are shown being separated from one another in the drawing to simply the drawing.

The housing 13 includes a casing 23 and a housing 13 between which a room 25 is disposed as shown in FIGS.

1 and 2. The seal 15 is put in the room 25. A male connector (now shown) engages with the seal 15 in the room 25.

A plurality of chambers 21 are formed in the casing 23, and at least a female electrical splicer 29 is positioned in each of the chamber 21. The spacer block 17 is inserted in a space 31 disposed under the chambers 21.

Figure 3:
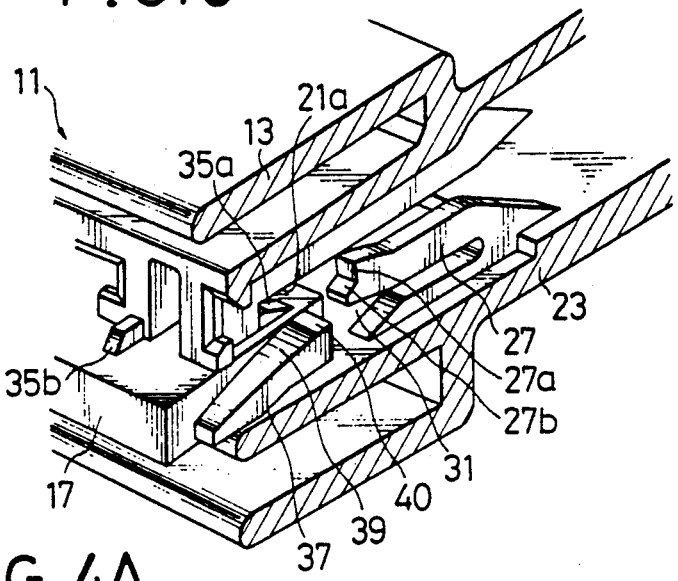
FIG. 3 is a sectional side view taken along the line III—III in FIG. 2.
Figure 4A:
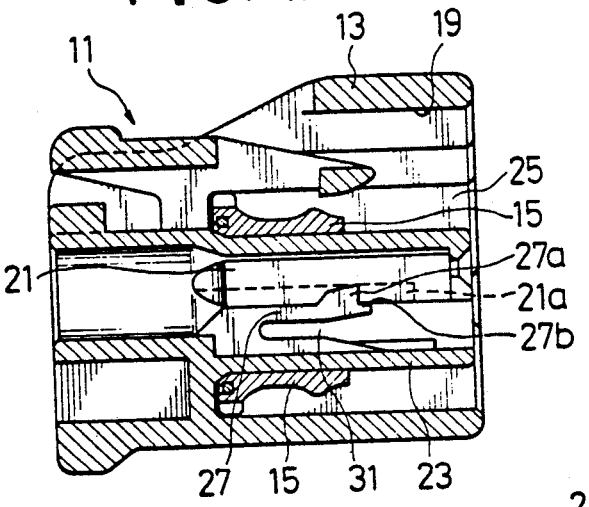
FIGS. 4A–4C are sectional side views taken along the line IV—IV in FIG. 2.

In FIGS. 3 and 4, at least one arm 27 is disposed fixedly in each of the chambers 21. The arm 27 extends horizontally and has a forked free end consisting of a first projection 27*a* and a second projection 27*b*, while the female splicer 29 has a notch 29*a*. The first projection 27*a* engages with the female splicer 29 through the notch 29*a* and prevents the splicer 29 from coming out from the chamber 21. The second projection 27*b* is used to disengage the first projection 27 from the splicer 29 when it is necessary to pull out the splicer 29 from the chamber 21.

The space 31 is disposed at one side of the arm 27 opposite the first projection 27*a*, that is, under the arm 27 in the case. The arm 27 is elastic and deflectable into the space 31 when force is so applied. The spacer block 17 is positioned finally in the space 31 under the arm 27 to prevent the arm 27 from deflecting involuntarily.

The spacer block 17 mainly consists of flat small parts 35 and inclined small parts 37 disposed between the flat small parts 35. The flat small parts 35 are inserted into voids between the chambers 21, while the inclined small parts 27 are inserted in the space 31 and positioned right under the arms 27. Each of the inclined small parts 37 has an inclined surface 29 to which a flat surface 40 is continued. The spacer block 17 is provided with first protuberances 35*a* and second protuberances 35*b*. The first protuberances 35*a* are mounted on frontal parts of the spacer block 17, while the second protuberances 35*b* are on rear parts.

Now, description will be made to insert the spacer block 17 into the space 31 and how to pull out the splicer 29 from the chamber 21.

Figure 4B:
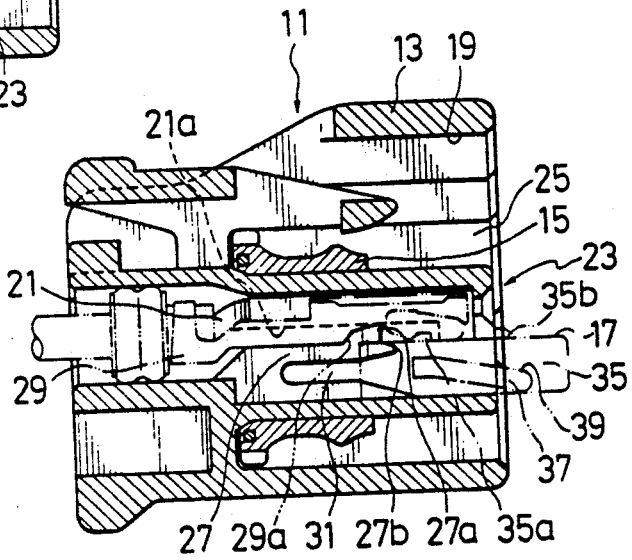

First, the spacer block 17 is inserted in the space 31 to some extent until the second protuberances 35*b* come into splicer with frontal parts of the chambers 21. In the result, the first protuberances 35*a* are engaged by notches 21*a* formed in the chambers 21 as shown in FIG. 3 and FIG. 4B. Therefore, the spacer block 17 is fixed in the space 31 not to move forwards nor backwards, and however, is not under the arm 27. This situation is called that the spacer block 17 is in a temporary position.

Figure 4C:
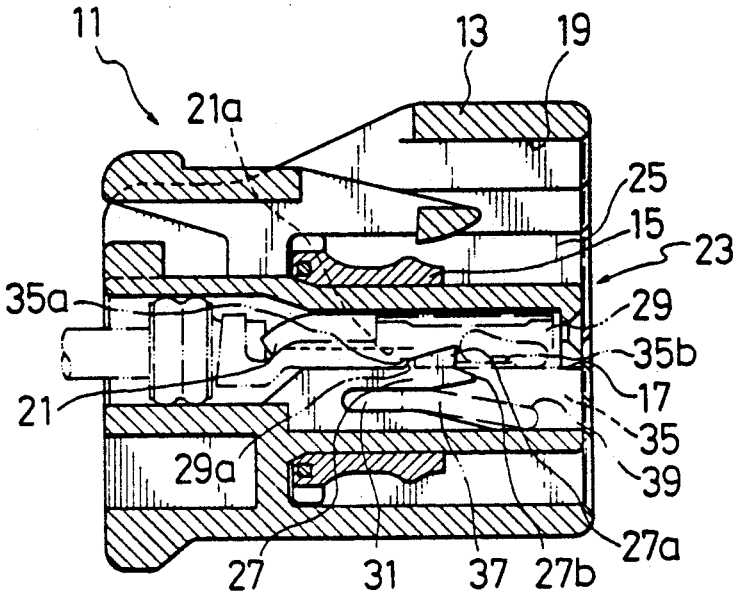

Then, the connector 11 is examined and tested when the spacer block 17 is in the temporary position. If it is not necessary to pull out the splicer 29 from the connector 11 as a result of examining and testing, the spacer block 17 is pushed further into the space 31 until the second protuberances 35*b* are engaged by the notches 21*a* as shown in FIG. 4C. In this state, distal ends with the flat surfaces 40 of the inclined small parts are positioned finally under the arm 27. Therefore, the splicers 29 are fixed in the chamber 21, because the arms 27 can not deflect and are engaged with the splicers 29 through the first projections 27*a*.

Figure 5:
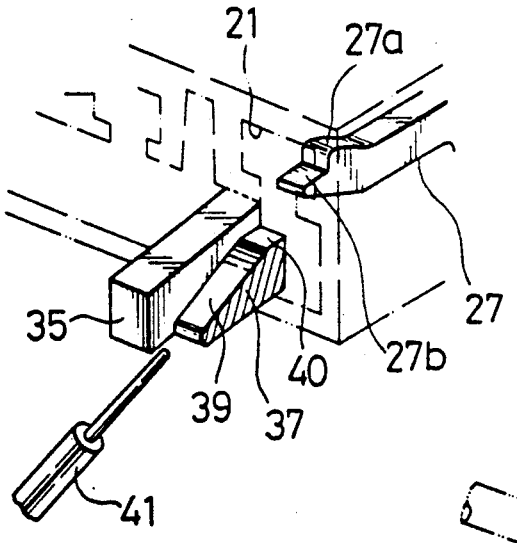
FIG. 5 is a perspective view explaining guiding of an implement to a free end of the arm through the spacer block.
Figure 6:
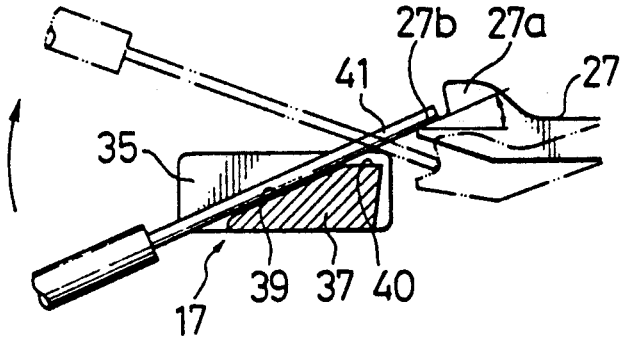
FIG. 6 is explanatory view showing disengagement of the free end of the arm from a splicer disposed in the connector.
Figure 7:
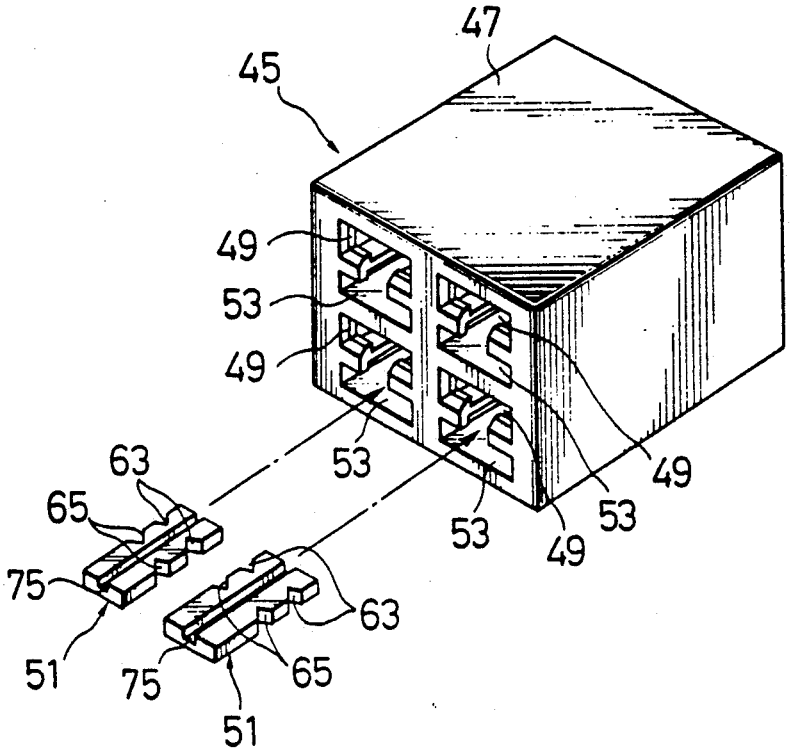
FIG. 7 is a perspective view showing another connector of the present invention.

If it is necessary to pull out the splicer 29 from the connector 11 as the result of examining and testing, an implement 41 is inserted in the space 31, and subsequently a d distal end of the implement 41 is guided along the inclined surface 39 of the spacer block 17 to the forked free end 27*a*, 27*b* of the arm 27 as shown in FIGS. 5 and 6. Accordingly, the distal end of the implement 41 engages accurately with the forked end of the arm 27. Then, the implement 41 is rotated as shown by an arrow in FIG. 6 to press the forked end 27*a*, 27*b* to disengage the first projection 27*a* from the splicer 29. After the splicer 29 is pulled out, and after a new or correct splicer is positioned in the chamber 21, the spacer block 17 is pushed into the final position.

When the implement 41 is inserted in the space 31 for disengaging the arm 27 from the splicer 29, it is not necessary to peep in the space 31 to look for the forked end 27*a*, 27*b*, because the implement is guided to the forked end of itself. According tot he above described connector 11, the splicer 29 can be pulled out easily and quickly.

In FIGS. 7–10, a second example of the connector of the present invention is shown. The connector 45 includes a housing 47 and spacer blocks 51. The housing 47 has, for example, four chambers 49 in which splicers 73 (FIG. 10) and deflectable arms 55 are positioned in the same manner as the first example. A space 53 is disposed under each of the chambers 49 and is continued to the chamber 49. The arm 55 is deflectable into the space 53 and has a first and second projections 57 and 59 at a free end. The first and second projections make a fork. The first projection 57 is engaged with the splicer 73 through a notch 73*a* in a conventional manner to prevent coming-out of the splicer 73 from the housing 47. The spacer block 51 is inserted in the space 53 until it comes under the arm 55 to prevent involuntary deflection of the arm 55.

The spacer block 51 is made of a serrated plate. A longitudinal groove 75 is formed on the central part of an upper surface of the spacer block 51, and a first and a second pairs of notches 63, 65 are formed at the both edges of spacer block 51. Width L1 of the spacer block 51 is bigger than width L2 of the free end 57, 59 of the arm 55, and width L3 of the groove 75 of the spacer block 51 is smaller than the width L2 of the free end 57, 59.

Figure 8:
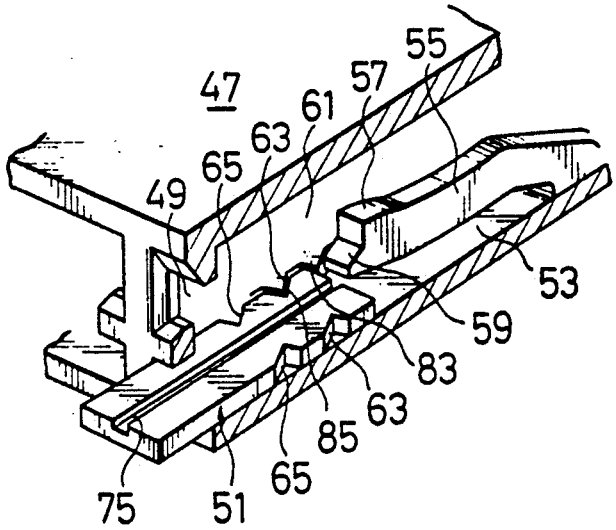
FIG. 8 is a sectional perspective view of the connector shown in FIG. 7, showing an arm and a spacer block.
Figure 9:
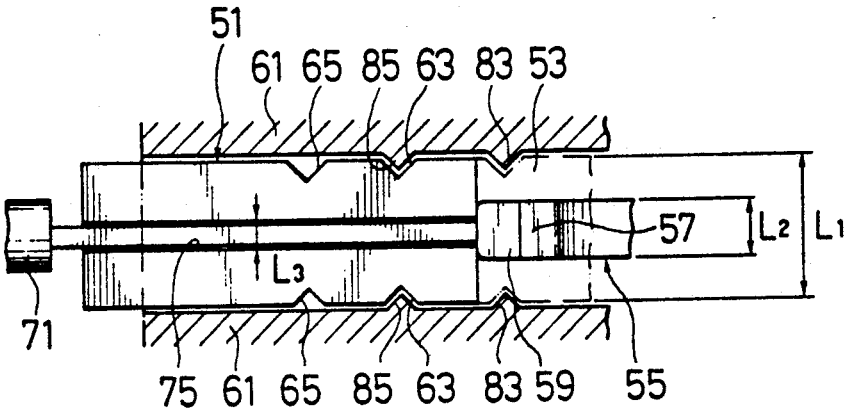
FIG. 9 is a plan showing the arm and the spacer block shown in FIG. 8.

On the other hand, two serrated members 61 are fixed in the chamber 49 as shown in FIGS. 8 and 9. Each of the serrated member 61 has a first tooth 83 and a second tooth 85. The first and second teeth 83, 85 extending the space 31 in which the spacer block 51 is inserted.

Figure 10A:
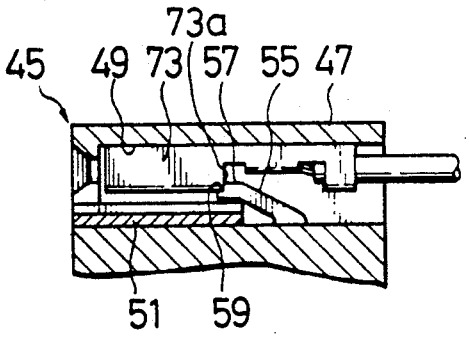
FIGS. 10A–10C are explanatory drawings showing how to disengage a splicer from the arm.

The spacer block 51 engages with the serrated members 61 in two positions and slidable between the positions when pushed or withdrawn with force exceeding a certain value. The spacer block 51 is normally placed in a final position as shown in FIG. 10A where the first teeth 83 of the serrated members 61 are engaged with the second pair of notches 65 of the spacer block 51, and the spacer block 51 is staying under the arm 55 to prevent the deflection of the arm 55.

Figure 10B:
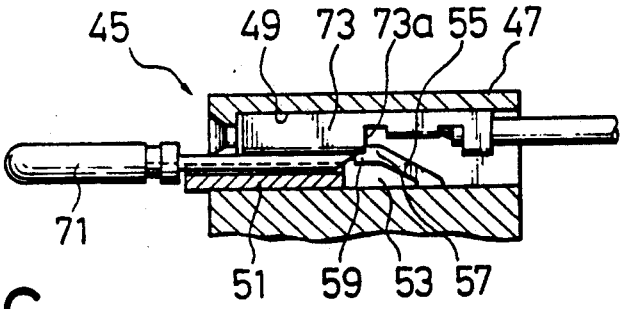
Figure 10C:
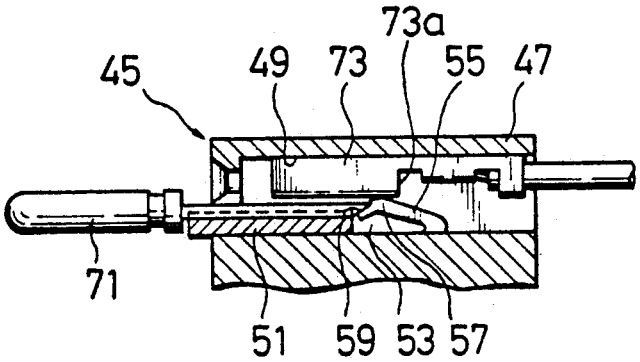

If it is necessary to pull out the splicer 73 from the chamber 49, the spacer block 51 in the final position is withdrawn with forced exceeding the certain value and placed in a temporary position (FIGS. 8 and 9) where the second teeth 85 are engaged with the first pair of notches 63, and the spacer block 51 is staying before the arm 55. Then, an implement 71 is inserted in the space 53 being guided along the groove 75 on the spacer block 51 to the forked end 57, 59 of the arm 55 as shown in FIG. 10B. In this state, the implement 71 is further pushed to lower the free end of the arm 55 as shown in FIG. 10C. Therefore, the splicer 73 is disengaged from the arm 55 and pulled out. Finally, the spacer block 51 is moved from the temporary position to the final position after a new, correct, or repaired splicer or wiring harness is positioned in the chamber 49.

According to the connector 45 of the present invention, the implement 71 is guided accurately without peeping in the space up to the forked free end of the arm, of itself. Therefore, the implement does not break the forked end, and the splicer is pulled out easily and quickly.

We claim:

1. An electrical connector comprising:

a housing;

at least one arm fixed in at least one chamber disposed in said housing, having a first projection at a free end, and deflectable into a space disposed at one side opposite said first projection, said first projection being for engaging with an electrical splicer positioned in said chamber and for preventing said splicer from disengaging said chamber; and at least a spacer block disposed finally in said space for preventing said arm from deflecting into said space, characterized in that said spacer block has devices by which said spacer block is engaged with said housing in a temporary position difference from a final position in which said spacer block is inserted into said space and that said spacer block has a guiding portion through which an implement for disengaging said first projection from said slicer is guided to said first projection of said arm when said spacer block is in said temporary position.

2. An electrical connector according to claim 1, characterized in that said guiding portion of said spacer block includes an inclined surface which extends toward said first projection of said arm when said spacer block is in said temporary position.

3. An electrical connector according to claim 2, wherein said arm includes a second projection at said free end which forms with said first projection a fork extending from an intersection, said intersection being disposed above a surface extending from said inclined surface of said guiding portion of said spacer block when said spacer block is in said temporary position.

4. An electrical connector according to claim 1, characterized in that said guiding portion includes a groove for guiding said implement to said first projection, said groove being narrower than said free end of said arm.

* * * * *

UNITED STATES PATENT AND TRADEMARK OFFICE

CERTIFICATE OF CORRECTION

PATENT NO. : 5,108,310

DATED : April 28, 1992

INVENTOR(S) : Yoshitsugu Sawada et al

It is certified that error appears in the above-indentified patent and that said Letters Patent is hereby corrected as shown below:

Column 2, line 64, delete "having an inner wall 19";
line 67, "delete "housing 13" and insert --hood 19--;

Column 3, line 6 "chamber" should be --chambers--;
line 29, "27" should be --37--;
line 31, "29" should be --39--;
line 65, before "distal" delete "d";

UNITED STATES PATENT AND TRADEMARK OFFICE

CERTIFICATE OF CORRECTION

PATENT NO. : 5,108,310

DATED : April 28, 1992

INVENTOR(S) : Yoshisugu Sawada et al

It is certified that error appears in the above-indentified patent and that said Letters Patent is hereby corrected as shown below:

Column 4, line 12, "tot he" should be --to the--;
line 44, "extending" should be --extend in--;
line 57, "forced" should be --force--.

IN THE CLAIMS:

Claim 1, column 6, line 4, "slicer" should be --splicer--.

Signed and Sealed this

Twenty-fourth Day of August, 1993

*Attest:*

*Attesting Officer*

BRUCE LEHMAN

*Commissioner of Patents and Trademarks*